US008802206B2

(12) United States Patent
Klingshirn et al.

(10) Patent No.: US 8,802,206 B2
(45) Date of Patent: Aug. 12, 2014

(54) REFRIGERATION APPLIANCE, AND METHOD FOR THE PRODUCTION OF A REFRIGERATION APPLIANCE

(75) Inventors: Astrid Klingshirn, Zusmarshausen (DE); Sandro Kohn, Bonn (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 367 days.

(21) Appl. No.: 13/264,997

(22) PCT Filed: Jun. 25, 2009

(86) PCT No.: PCT/EP2009/057999

§ 371 (c)(1), (2), (4) Date: Oct. 18, 2011

(87) PCT Pub. No.: WO2010/127715

PCT Pub. Date: Nov. 11, 2010

(65) Prior Publication Data

US 2012/0045601 A1 Feb. 23, 2012

(30) Foreign Application Priority Data

May 4, 2009 (DE) ..... 10 2009 002 797
May 4, 2009 (DE) ..... 10 2009 002 799

(51) Int. Cl.
*B29D 22/00* (2006.01)
*B29D 23/00* (2006.01)
*B32B 1/08* (2006.01)

(52) U.S. Cl.
USPC ..... 428/35.7; 428/34.1; 62/264; 362/92; 312/404

(58) Field of Classification Search
USPC ..... 62/264; 362/92; 312/404; 428/34.1, 428/35.7
See application file for complete search history.

(56) References Cited

U.S. PATENT DOCUMENTS

| | | | |
|---|---|---|---|
| 4,955,208 | A | 9/1990 | Kawashima et al. |
| 2004/0214010 | A1 | 10/2004 | Murata et al. |

FOREIGN PATENT DOCUMENTS

| | | | |
|---|---|---|---|
| DE | 102006024093 | A1 | 11/2007 |
| JP | 2002-035599 | | 2/2002 |
| JP | 2004028386 | A | 1/2004 |
| JP | 2006046844 | A | 2/2006 |
| JP | 2007139230 | A | 6/2007 |
| JP | 2008075887 | A | 4/2008 |
| SU | 1296801 | | 3/1987 |
| WO | 2005007756 | A1 | 8/2005 |
| WO | WO 2005/097302 | | 10/2005 |
| WO | 2007072165 | A2 | 6/2007 |
| WO | WO 2010/127715 | | 11/2010 |

OTHER PUBLICATIONS

International Search Report PCT/EP2009/057999.
Report of Examination Including National Search Report CN 200980159140.0 issued Mar. 11, 2013.
Decision on Granting issued Russian Patent Application No. 2011143287/13 issued on Oct. 29, 2013.

*Primary Examiner* — Michael C Miggins
(74) *Attorney, Agent, or Firm* — Nixon & Vanderhye, P.C.

(57) ABSTRACT

A refrigeration appliance includes a refrigerating space, a light-guiding layer, and a multi-layered part having a photocatalytic cover layer on a side facing the refrigerating space. The photocatalytic cover layer is applied to the light-guiding layer which enables light to be ducted to the photocatalytic cover layer.

48 Claims, 4 Drawing Sheets

REFRIGERATION APPLIANCE, AND METHOD FOR THE PRODUCTION OF A REFRIGERATION APPLIANCE

BACKGROUND OF THE INVENTION

The invention relates to a refrigeration appliance according and to a method for producing a refrigeration appliance.

The use is known of a photocatalytic layer, such as a $TiO_2$ layer, for providing self-cleaning surfaces. The photocatalytic coating can remove organochemical impurities and/or act antibacterially when subjected to light.

Known from WO 2007/072165 A2 is a generic refrigeration appliance in which the inner wall delimiting a refrigerating space as well as a drawer have been provided with a photocatalytic cover layer. Arranged on the cover wall of the refrigerating space is a light source by means of which the photocatalytic cover layer can be activated in order as a catalyst to accelerate the oxidizing of organic deposits on the surfaces facing the refrigerating space. The refrigerating space is for that purpose illuminated by the light source when the door of the refrigeration appliance has been closed. Refrigerating-space illuminating of such kind can, though, also accelerate oxidation processes in certain items being refrigerated with correspondingly adverse effects on the quality of such items.

It is known from WO 2005/077556 A1 how to provide viewing windows of cooking-appliance doors with a photocatalytic layer. The viewing window is made of glass or a polymer material and serves as a light guide for subjecting the photocatalytic layer to light.

Known from DE 10 2006 024 093 A1 is a coating for keeping surfaces that come into contact with liquid media or aerosols clean. The coating has on its surface a photocatalytic layer applied to a light-emitting layer.

BRIEF SUMMARY OF THE INVENTION

The object of the invention is to provide a refrigeration appliance or, as the case may be, a method for producing a refrigeration appliance in the case of which photocatalytic layers can be used in the refrigerating space without adversely affecting the quality of items being refrigerated.

Said object is achieved by means of the features of claim 1 or claim 9. Preferred developments of the invention are disclosed in the subclaims.

The photocatalytic cover layer has according to the characterizing part of claim 1 been applied to a light-guiding layer via which the light can be ducted to the photocatalytic cover layer. The catalytic cover layer is thus inventively not subjected to light directly from the refrigerating space but the cover layer is instead activated by means of light on its side facing away from the refrigerating space.

The inventive molded part can be produced by deep-drawing as, by way of example, an inner wall of the refrigeration appliance delimiting the refrigerating space or as a slide-out part such as a vegetable drawer or meat tray. Against that background it is advantageous for the light-guiding layer to have been produced from a moldable material, particularly one that can be deep-drawn. The light-guiding layer and photocatalytic cover layer can in that way be technically advantageously joined together ahead of the reshaping operation. A semi-finished item having a two-layer structure can thus be provided that can undergo ensuing shaping through deep-drawing, for instance.

The light-guiding layer and photocatalytic cover layer can together form a two-layer structure in which the light-guiding layer can be embodied as a support layer of the molded part. A two-layer structure of such kind is advantageous particularly in the production of a slide-out part which is usually made of a transparent material such as polystyrene or SAN that can be used as a light-guiding material and is at the same time sufficiently dimensionally stable to act as a support layer. The support layer can in the case of a two-layer structure of such kind have a layer thickness in the 1-to-6-mm range while the photocatalytic cover layer is in a range less than 1 mm.

The inner wall of the refrigeration appliance delimiting the refrigerating space can be made of polystyrene. The polystyrene inner wall can act inventively as a support layer for the aforementioned combination consisting of a light-guiding layer and cover layer. The light-guiding layer is therefore arranged between the polystyrene inner wall and photocatalytic cover layer in the thus formed three-layer structure. The inner wall can be made also of SAN or ABS instead of polystyrene. The layer thickness of the light-guiding layer can in this three-layer structure be reduced compared with the aforementioned two-layer structure and be in the 1-to-2-mm range.

The photocatalytic cover layer can by preference from the production viewpoint have a photoactive material, for example $TiO_2$, that is incorporated into a basic material, for example the polystyrene. The photoactive material can in that case already be integrated in the basic material's plastic granules. The cover layer and light-guiding layer preferably have the same material properties. It is thus advantageous for the basic material of the photocatalytic cover layer to be capable of being deep-drawn like the light-guiding layer. The basic material of the photocatalytic cover layer and the material of the light-guiding layer preferably belong to the same material families or are identical. It will as a result be possible to produce laminate or, as the case may be, bonding forces between the two layers sufficiently large to prevent the cover layer becoming detached from the light-guiding layer.

The molded part can as already mentioned above be shaped in a deep-drawing process. The photocatalytic cover layer can be joined to the light-guiding layer ahead of a deep-drawing process of such kind at a first production step, for example by means of extrusion. The thus provided plate-shaped semi-finished item is then brought to a shaping temperature for a deep-drawing operation and thereafter taken to a deep-drawing device in which the molded part can be shaped.

During the production of a molded part having a three-layer structure and employed as a refrigeration appliance's inner wall, the photocatalytic cover layer can be coated onto a support layer with the light-guiding layer being located in between. The thus produced three-layered semi-finished item is then likewise taken to a deep-drawing device.

As an alternative to the preceding exemplary embodiments it is possible also for shaping to take place using the deep-drawing method with the photocatalytic cover layer being omitted. The cover layer can in that case not be applied to the surface facing the refrigerating space until shaping has been performed. Post-coating of such kind can be done using a PVD process known per se, by applying an appropriate liquid lacquer, by applying a coating powder, or by using a sol-gel process.

Post-coating of the already deep-drawn molded part can alternatively be done by means of a subsequent plasma treatment or, as the case may be, plasma coating with a $TiO_2$ suspension or by means of a siloxane coating with embedded $TiO_2$ particles.

BRIEF DESCRIPTION OF THE DRAWINGS

Two exemplary embodiments of the invention are described below with the aid of the attached figures.

DETAILED DESCRIPTION OF EXEMPLARY EMBODIMENTS OF THE PRESENT INVENTION

Figure 1:
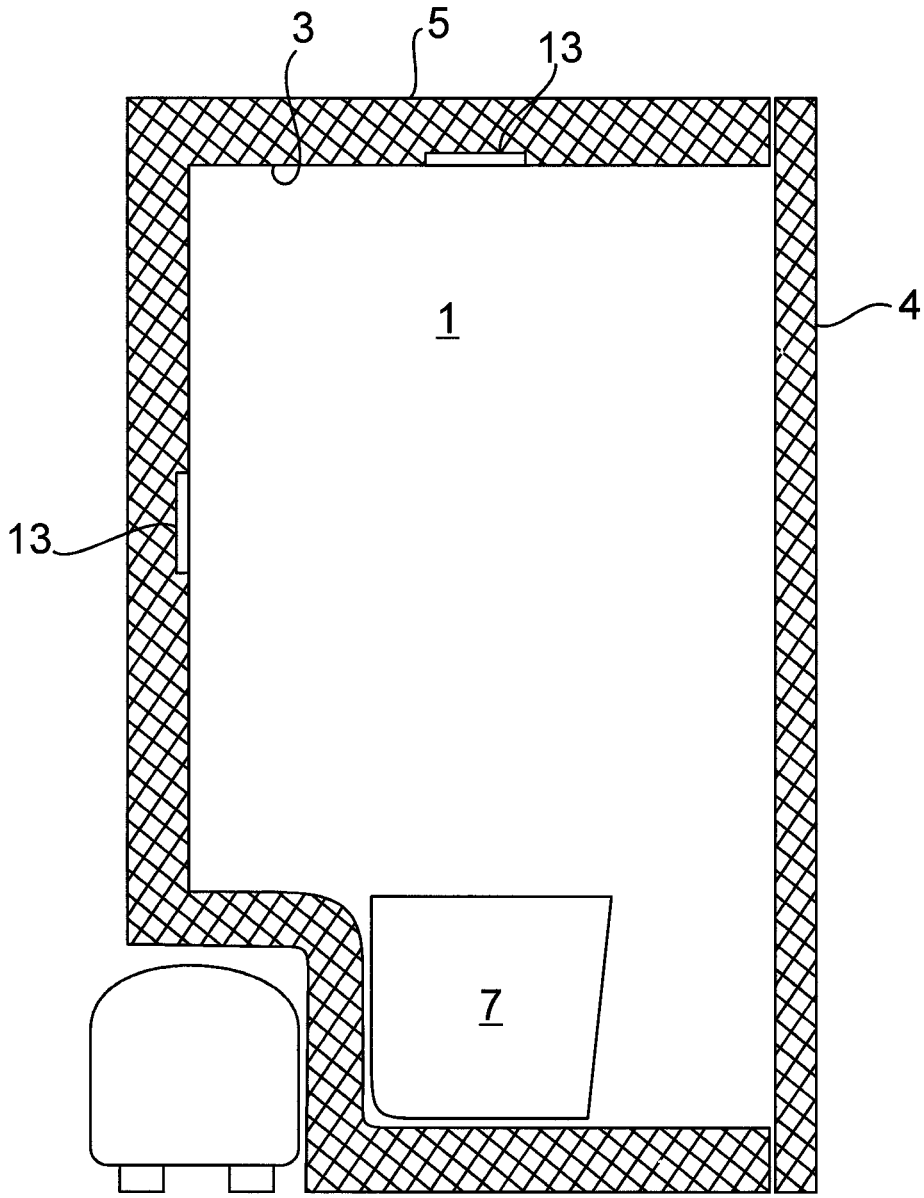
FIG. 1 is a schematic lateral cross-sectional representation of a refrigeration appliance.

FIG. 1 is a lateral cross-sectional representation of a refrigeration appliance having a refrigerating space 1 delimited by an inner wall 3. Refrigerating space 1 is closed by what in FIG. 1 is a right-hand appliance door 4. A thermally insulating layer is arranged in a known manner between inner wall 3 and an outer housing 5. Inner wall 3 is produced in a known manner from a plastic material by the deep-drawing process. Located on the floor of refrigerating space 1 is a drawer 7, for vegetables and suchlike, which can have been produced by plastic injection molding.

Figure 2:
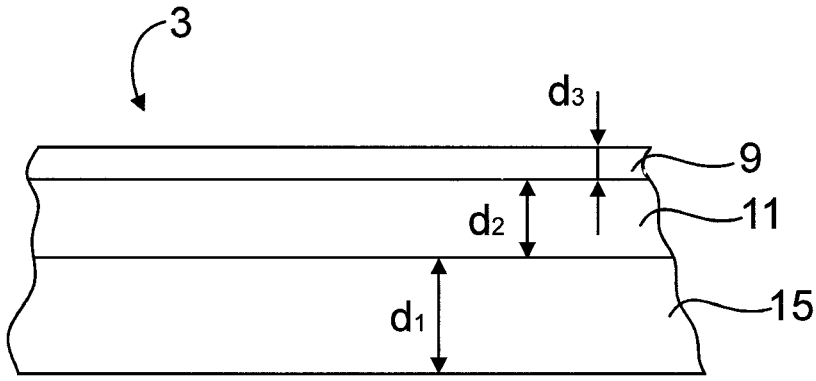
FIG. 2 shows a material structure, according to the first exemplary embodiment, of an inner wall delimiting the refrigeration appliance's refrigerating space.
Figure 3:
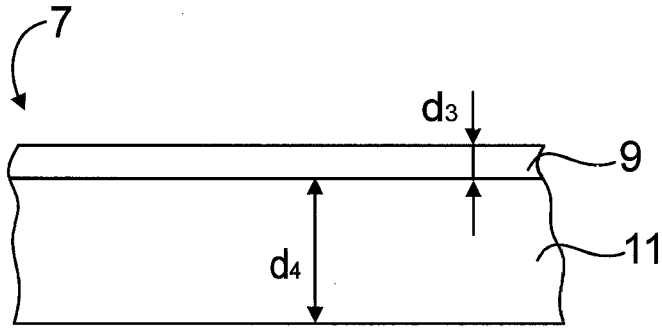
FIG. 3 shows a material structure, according to the second exemplary embodiment, of a drawer located in the refrigerating space.

The material structure of inner wall 3 and drawer 7 is shown in FIGS. 2 and 3. Consequently both inner wall 3 and drawer 7 have on their surfaces facing refrigerating space 1 a photocatalytic cover layer 9 that can be activated by means of light, particularly UV light, in order to oxidize for example organic deposits on drawer 7 or, as the case may be, inner wall 3.

As can be seen from FIGS. 2 and 3, photocatalytic cover layer 9 has been applied to a light-guiding layer 11. Light-guiding layer 11 is optically coupled via coupling points that are not shown to light sources 13 integrated in inner wall 3. Photocatalytic cover layer 9 can as a result be subjected to UV light on its side facing away from refrigerating space 1, while refrigerating space 1 will not be subjected to UV light.

Light sources 13 can be LEDs that emit light at a wavelength of 365 to 420 nm. LEDs 13 can be directly integrated in light-guiding layer 11.

According to FIG. 2, light-guiding layer 11 is arranged between photocatalytic cover layer 9 and a dimensionally stable, usually colored support layer 15. Support layer 15 here consists by way of example of polystyrene having a material thickness $d_1$ in the order of 4 to 5 mm. Middle light-guiding layer 11 consists likewise of polystyrene and has a material thickness $d_2$ of for example 1 to 2 mm, while cover layer 9 has a material thickness $d_3$ in the order of less than 1 mm.

Photocatalytic cover layer 9 can as a photoactive material have $TiO_2$ particles incorporated in a polystyrene basic material. Cover layer 9 having the polystyrene basic material, light-guiding layer 11, and support layer 15 are to that extent embodied as materially the same, as a result of which high laminate or, as the case may be, bonding forces can be achieved between the layers in a simple manner. The material structure shown in FIG. 2 can be achieved technically simply by means of three-layer extrusion.

In contrast to the three-layer structure of inner wall 3 shown in FIG. 2, drawer 7 shown in FIG. 3 has a double-layer structure. Light-guiding layer 11 will in that case have a double function, acting simultaneously as a dimensionally stable support layer. Compared with light-guiding layer 11 shown in FIG. 2, light-guiding layer 11 made of polystyrene has therefore been formed having a greater material thickness $d_4$ in the range up to 5 mm.

Figure 4:
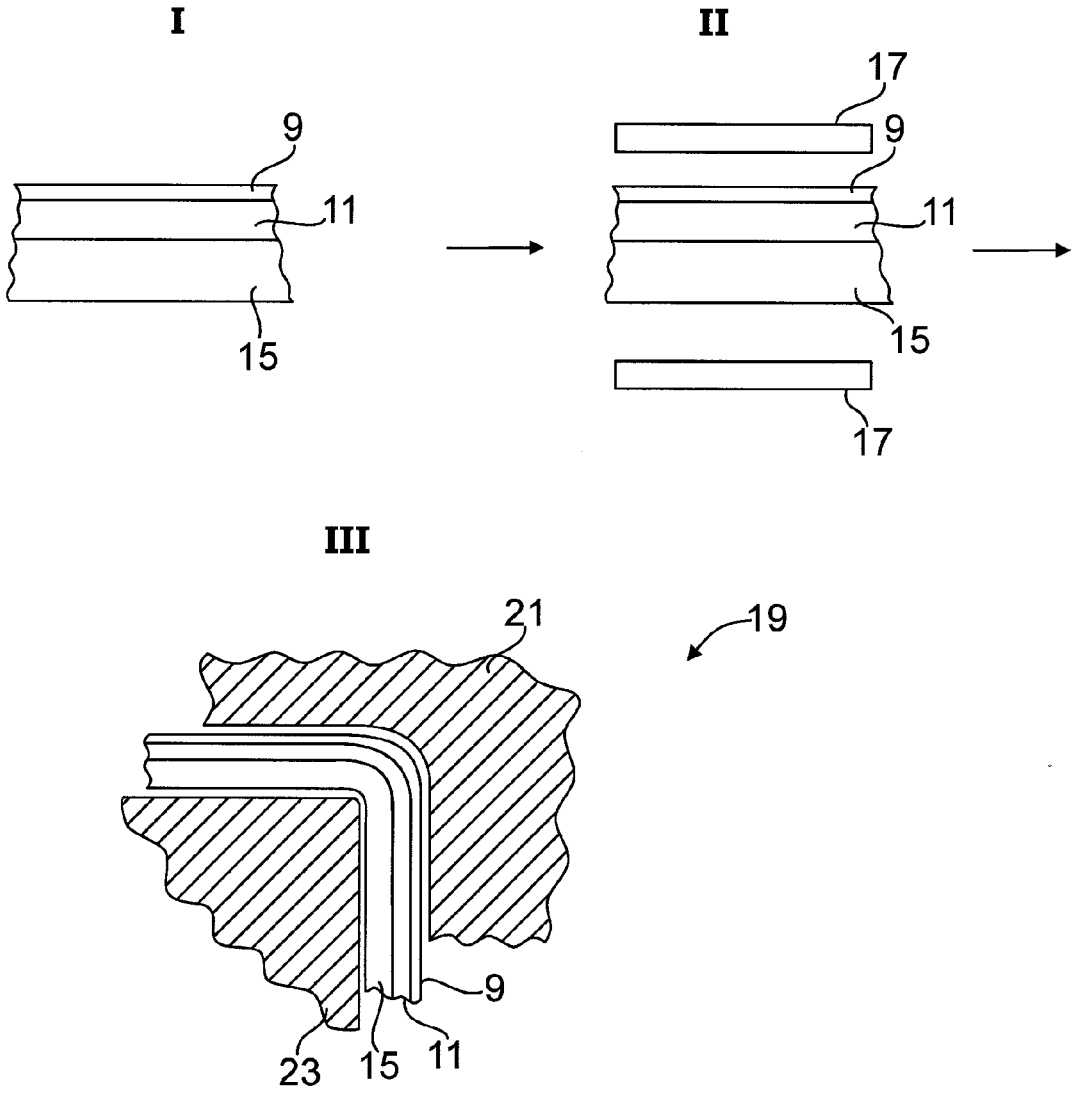
FIGS. 4 and 5 are schematic representations illustrating methods for producing inventive molded parts.
Figure 5:
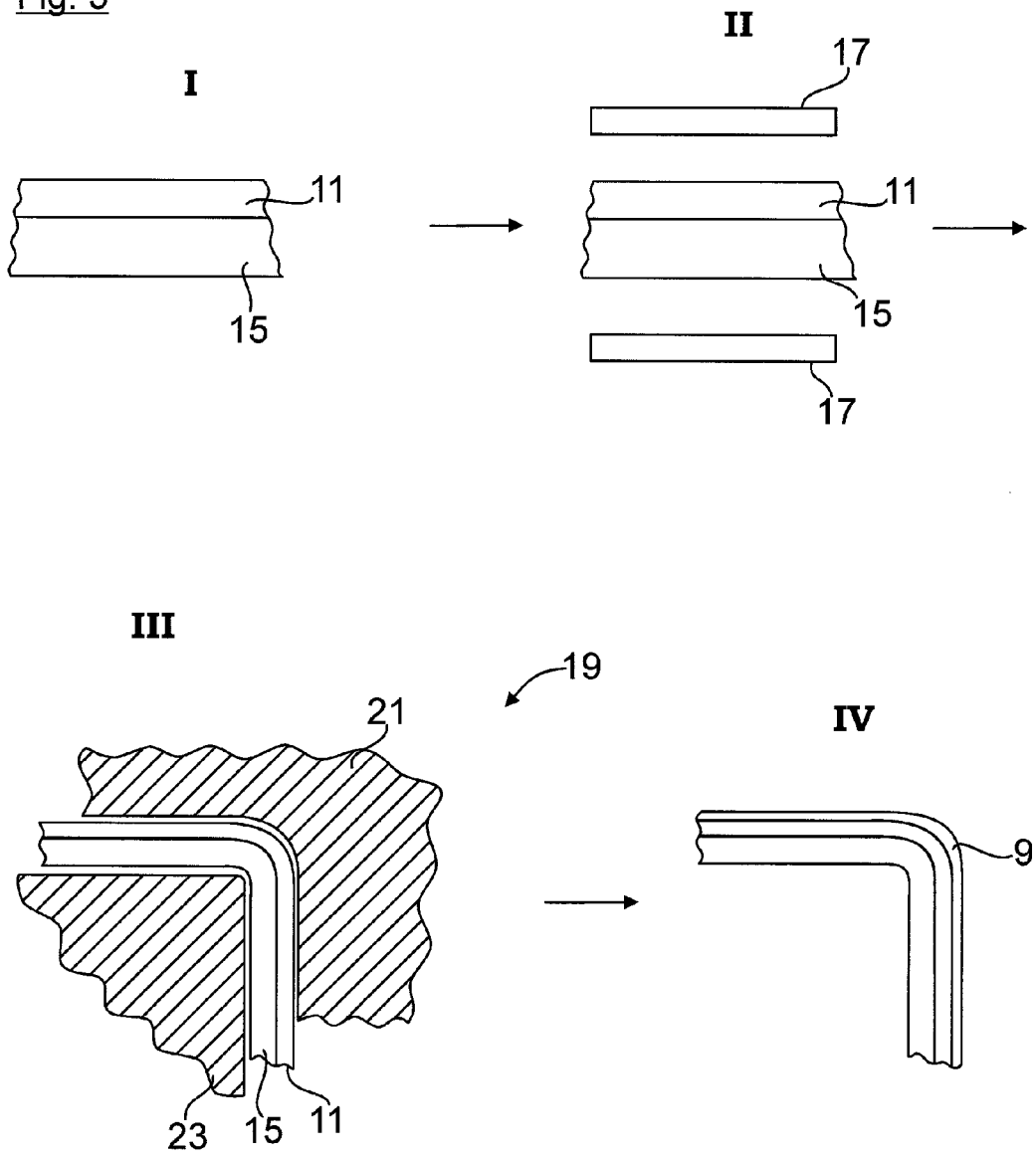

FIGS. 4 and 5 each illustrate a method for producing a molded part that can be used as an inner wall 3 and whose material structure is shown in FIG. 2. According to FIG. 4, a three-layered blank part comprising photocatalytic cover layer 9, light-guiding layer 11, and support layer 15 produced by three-layer extrusion is provided as a semi-finished item at a step I of the method. The blank part is pre-heated at an ensuing pre-heating step II preceding the deep-drawing process to a shaping temperature in a heating field 17. When the shaping temperature has been reached, the pre-heated blank part is conveyed into a deep-drawing device 19 at deep-drawing step III. During the deep-drawing operation an upper deep-drawing tool 21 is moved towards the lower tool part 23, with the blank part therein undergoing pressing with a defined deep-drawing clearance remaining, as a result of which the blank part will have been shaped. The molded part is then removed from deep-drawing device 19.

In the production process shown in FIG. 4, photocatalytic cover layer 9 is applied to light-guiding layer 11 before shaping takes place in deep-drawing device 19. Photocatalytic cover layer 9 will therefore be subjected to both mechanical and thermal loads during the deep-drawing process so that cover layer 9 needs to be implemented suitably robustly. Against that background, in the method shown in FIG. 4 a photocatalytic cover layer 9 is used whose basic material is polystyrene into which the photoactive $TiO_2$ particles have been incorporated. The basic material of cover layer 9 is hence substantially materially the same as light-guiding layer 11, as a result of which a high degree of laminate adhesion can be produced between the two layers. Using the polystyrene basic material will in addition increase the thermal or, as the case may be, mechanical stability of cover layer 9 sufficiently for ensuing shaping to be achieved without damage.

FIG. 5 likewise illustrates a method for producing a molded part that has a three-layer structure and can be used as an inner wall 3. In contrast to the production method shown in FIG. 4, what is produced here by two-layer coextrusion is a blank part which in this case is a two-layer bond consisting of light-guiding layer 11 and support layer 15. The blank part is then subjected to a shaping process in deep-drawing device 19. Not until ensuing step IV of the method is photocatalytic cover layer 9 applied to the already deep-drawn molded part. Photocatalytic cover layer 9 can with post-coating of such kind be applied using a technically easy-to-perform PVD process, by applying a liquid lacquer or coating powder, or by using a sol-gel process. With post-coating it is therefore possible to avoid mechanical or, as the case may be, thermal loading of cover layer 9 due to the deep-drawing process. The cover layer can therefore be applied to inner wall 3 with greatly reduced production effort.

LIST OF REFERENCES

1 Refrigerating space
3 Inner wall
5 Outer housing
7 Drawer
9 Photocatalytic cover layer
11 Light-guiding layer
13 Light source
15 Support layer
17 Heating field
19 Deep-drawing device
21, 23 Deep-drawing tools
$d_1$ to $d_4$ Material thicknesses

The invention claimed is:

1. A refrigeration appliance, comprising:

a refrigerating space;

an inner wall at least partially delimiting the refrigerating space, the inner wall including a light-guiding layer and a photocatalytic cover layer applied to the light-guiding layer, the photocatalytic cover layer having a side exposed to the refrigerating space, wherein the light-guiding layer is configured to duct light to the photocatalytic cover layer.

2. The refrigeration appliance of claim 1, constructed in the form of a domestic refrigeration appliance.

3. The refrigeration appliance of claim 1, further comprising an intermediate layer made of an inert material and provided between the photocatalytic cover layer and the light-guiding layer.

4. The refrigeration appliance of claim 1, wherein the light-guiding layer has a layer thickness of 1 to 6 mm.

5. The refrigeration appliance of claim 1, wherein the photocatalytic cover layer has a layer thickness of less than 1 mm.

6. The refrigeration appliance of claim 1, wherein the light-guiding layer and the photocatalytic cover layer are formed of the same basic material.

7. The refrigeration appliance of claim 1, wherein the inner wall is a molded part.

8. The refrigeration appliance of claim 7, further comprising an additional support layer, wherein the light-guiding layer is applied to the additional support layer, thereby forming a three-layer structure of the molded part.

9. The refrigeration appliance of claim 8, wherein the three-layer structure is produced by coextrusion.

10. The refrigeration appliance of claim 8, wherein the additional support layer in the three-layer structure of the molded part is a polystyrene, SAN, or ABS.

11. The refrigeration appliance of claim 8, wherein the additional support layer has a layer thickness of 3 to 6 mm.

12. The refrigeration appliance of claim 1, wherein the light-guiding layer is made from a material configured to be deep-drawn.

13. The refrigeration appliance of claim 12, wherein the light-guiding layer is made from polystyrene or SAN.

14. The refrigeration appliance of claim 1, wherein the light-guiding layer and the photocatalytic cover layer together form a two-layer structure, with the light-guiding layer being embodied as a support layer of the two-layer structure.

15. The refrigeration appliance of claim 14, wherein the two-layer structure is produced by coextrusion.

16. The refrigeration appliance of claim 1, wherein the photocatalytic cover layer has a photoactive material incorporated into a basic material.

17. The refrigeration appliance of claim 16, wherein the photoactive material is $TiO_2$.

18. The refrigeration appliance of claim 16, wherein the basic material is polystyrene.

19. The refrigeration appliance of claim 16, wherein the basic material is configured to be deep-drawn.

20. A method of forming an inner wall of a refrigeration appliance, comprising:

providing a light-guiding layer;

applying a photocatalytic cover layer on the light-guiding layer, the photocatalytic cover layer being configured to be exposed to a refrigerating space of the refrigeration appliance, wherein the light-guiding layer is configured to duct light to the photocatalytic cover layer.

21. The method of claim 20, wherein the photocatalytic cover layer is applied to the light-guiding layer after the light-guiding layer has been shaped.

22. The method of claim 20, wherein the light-guiding layer is made from polystyrene or SAN.

23. The method of claim 20, further comprising providing an intermediate layer made of an inert material between the photocatalytic cover layer and the light-guiding layer.

24. The method of claim 20, wherein the light-guiding layer has a layer thickness of 1 to 6 mm.

25. The method of claim 20, wherein the photocatalytic cover layer has a layer thickness of less than 1 mm.

26. The method of claim 20, wherein the basic material is adapted to being deep-drawn.

27. The method of claim 20, wherein the light-guiding layer and the photocatalytic cover layer are formed of the same basic material.

28. The method of claim 20, wherein the applying step including coating the photocatalytic cover layer onto the light-guiding layer by extrusion at a first production step before the light-guiding layer and the photocatalytic cover layer are shaped.

29. The method of claim 28, wherein the photocatalytic cover layer is coated onto the light-guiding layer by coextrusion.

30. The method of claim 28, further comprising deep-drawing the light-guiding layer and the photocatalytic layer to form a shaped molded part.

31. The method of claim 28, wherein the photocatalytic cover layer is coated onto a support layer at the first production step with the light-guiding layer being located in between, thereby forming a three-layer structure of a molded part.

32. The method of claim 31, wherein the three-layer structure is produced by coextrusion.

33. The method of claim 31, wherein the support layer in the three-layer structure of the molded part is a polystyrene, SAN, or ABS.

34. The method of claim 31, wherein the support layer has a layer thickness of 3 to 6 mm.

35. The method of claim 20, wherein the photocatalytic cover layer has a photoactive material incorporated into a basic material.

36. The method of claim 35, wherein the photoactive material is $TiO_2$.

37. The method of claim 35, wherein the basic material is polystyrene.

38. A refrigeration appliance, particularly a domestic refrigeration appliance, having a multi-layered, particularly molded part which on its side facing the refrigeration appliance's refrigerating space has a photocatalytic cover layer, wherein the photocatalytic cover layer has been applied to a light-guiding layer via which light can be ducted to the photocatalytic cover layer, wherein the photocatalytic cover layer has a photoactive material, for example $Ti0_2$, that is incorporated into a basic material, wherein the basic material of the photocatalytic cover layer as well as the light-guiding layer are capable of being deep-drawn, and wherein the basic material of the photocatalytic cover layer and the material of the light-guiding layer preferably belong to the same material families or are identical.

39. The refrigeration appliance as claimed in claim 38, wherein the light-guiding layer is made from polystyrene or SAN.

40. The refrigeration appliance as claimed in claim 38, wherein the light-guiding layer and photocatalytic cover layer together form a two-layer structure that is produced particularly by coextrusion and in which the light-guiding layer is embodied as a support layer of the molded part.

41. The refrigeration appliance as claimed in claim 38, wherein the case of the molded part the light-guiding layer has been applied to an additional support layer thereby forming a three-layer structure produced particularly by coextrusion.

42. The refrigeration appliance as claimed in claim 41, wherein the support layer in the three-layer structure of the molded part is a polystyrene, SAN, or ABS.

43. The refrigeration appliance as claimed claim 38, wherein an intermediate layer made of an inert material has been provided between the photocatalytic cover layer and light-guiding layer.

44. The refrigeration appliance as claimed claim 38, wherein the layer thickness ($d_1$ to $d_4$) of the light-guiding layer is 1 to 6 mm, of the additional support layer 3 to 6 mm, and/or of the photocatalytic cover layer less than 1 mm.

45. A method for producing a molded part for a refrigeration appliance as claimed in claim 38.

46. The method as claimed in claim 45, wherein the photocatalytic cover layer is coated onto the light-guiding layer by means of, for example, extrusion, particularly coextrusion, at a first production step (I) before the molded part is shaped in, for example, a deep-drawing process.

47. The method as claimed in claim 45, wherein the photocatalytic cover layer is coated onto the support layer at the first production step (I) with the light-guiding layer being located in between.

48. The method as claimed in claim 45, wherein the photocatalytic cover layer is applied to the light-guiding layer when the molded part has been shaped.

* * * * *